US011128960B2

(12) United States Patent
Holmberg

(10) Patent No.: US 11,128,960 B2
(45) Date of Patent: Sep. 21, 2021

(54) ELECTRONIC DEVICES WITH PROTECTIVE CAPACITY

(71) Applicant: Cochlear Limited, Macquarie University (AU)

(72) Inventor: Paul Francis Holmberg, Marsfield (AU)

(73) Assignee: Cochlear Limited, Macquarie University (AU)

( * ) Notice: Subject to any disclaimer, the term of this patent is extended or adjusted under 35 U.S.C. 154(b) by 2572 days.

(21) Appl. No.: 13/626,718

(22) Filed: Sep. 25, 2012

(65) Prior Publication Data

US 2014/0086440 A1 Mar. 27, 2014

(51) Int. Cl.
*H04R 25/00* (2006.01)

(52) U.S. Cl.
CPC ..... *H04R 25/305* (2013.01); *H04R 25/505* (2013.01); *H04R 25/60* (2013.01); *H04R 25/606* (2013.01); *H04R 25/554* (2013.01); *H04R 25/558* (2013.01); *H04R 2225/39* (2013.01)

(58) Field of Classification Search
CPC .... H04R 25/45; H04R 25/505; H04R 25/554; H04R 25/558; H04R 25/606; H04R 2225/41; H04R 2225/61; H04R 25/60; H04R 2225/63; H04R 25/305; H04R 2225/39; A61N 1/36032
USPC ..... 381/312, 314, 315, 322, 323, 330, 123, 381/381, 326, 380; 379/52; 600/25; 607/55, 56, 57
See application file for complete search history.

(56) References Cited

U.S. PATENT DOCUMENTS

| | | | | |
|---|---|---|---|---|
| 4,763,077 | A | 8/1988 | Miller | |
| 4,910,627 | A | 3/1990 | Mahlich | |
| 4,955,729 | A * | 9/1990 | Marx | 381/322 |
| 6,021,207 | A * | 2/2000 | Puthuff et al. | 381/330 |
| 7,174,214 | B2 * | 2/2007 | Seligman | A61N 1/36032 607/57 |
| 7,554,453 | B2 | 6/2009 | Snyder et al. | |
| 7,599,508 | B1 * | 10/2009 | Lynch et al. | 381/330 |
| 8,094,848 | B1 * | 1/2012 | Frerking et al. | 381/315 |
| 2006/0052841 | A1 * | 3/2006 | Daly | A61N 1/08 607/57 |
| 2008/0200779 | A1 * | 8/2008 | Zimmerling | A61N 1/36032 600/309 |
| 2009/0177247 | A1 * | 7/2009 | Neal | A61N 1/36032 607/57 |
| 2012/0114156 | A1 * | 5/2012 | Serman et al. | 381/314 |

* cited by examiner

*Primary Examiner* — Huyen D Le
(74) *Attorney, Agent, or Firm* — Pilloff Passino & Cosenza LLP; Martin J. Cosenza

(57) ABSTRACT

Electronic devices are designed having a housing and are configured to provide an improved degree of protection to electrical and/or mechanical components disposed therein that may be susceptible to damage from environmental elements external from the housing. The electrical device can be one carried or worn by a user, e.g., on the user's head, which can include an external component of a hearing prosthesis. The electrical device can be configured to provide an output signal in the event that a predetermined condition within the housing is detected to alert the user and/or place the electrical device in an alternative state of operation.

34 Claims, 5 Drawing Sheets

ELECTRONIC DEVICES WITH PROTECTIVE CAPACITY

FIELD

Electronic devices and methods for using the same as disclosed here are configured in a manner to provide an enhanced level of protection to internal components.

BACKGROUND

Conventional electronic devices include those that are remotely-powered, e.g., battery-powered. A category of such electronic devices includes those that are either carried or worn by a person, and include such things as cellular phones, cellular phone "hands-free" audio devices such as Bluetooth-connected devices and the like, audio players, watches, and medical devices such as external components of a hearing prosthesis. Each of these example known electrical devices comprise a number of electrical and/or mechanical components that are disposed within a housing or the like to protect the components from damage that can occur as a result or a number of different causes.

For example, the electrical and/or mechanical internal components of such electrical devices can be damaged from exposure to normal wear and tear, from being dropped or otherwise impacted by an external object, and/or from exposure to environment elements such as sun, heat, cold and/or moisture. In the event that an internal component within such electronic devices is affected by one or more of these elements, this can operate to impair the proper operation of the electrical device, and can ultimately damage the component so that the device no longer functions, thereby effectively shortening the effective service life of the electrical device. Where the device is phone, an audio player or the like, this means that the user may no longer be able to enjoy the benefit using the device providing both an inconvenience and expense in requiring replacement. When the device is a medical device, e.g., an external component of a hearing prosthesis, the user or recipient may lose the ability to hear which may operate to place the user in a dangerous situation depending on what the user is doing at the particular moment of device failure, this in addition to the expense incurred in having to replace the damaged device.

SUMMARY

Electrical devices or apparatus as disclosed herein generally comprise a housing that includes one or more electrical and/or mechanical components disposed therein. In an example, the electrical and/or mechanical components can have a performance feature sensitive to or that degrades when subjected to a high-level of moisture. In an example, the device can be one worn by a user, e.g., on the user's head. In a particular example, the device can be an external component of a hearing prosthesis worn adjacent a user's ear.

Electrical devices as disclosed herein are specially configured to have a self-protective capacity with respect to a previously ignored or unappreciated vulnerability through the use of a sensor positioned to detect a condition that may otherwise impair operation of the electrical and/or mechanical components disposed within the housing. In an example, the device comprises a moisture detector or sensor disposed within the housing. The sensor can be placed within the housing in a manner to provide an early indication of moisture presence within the housing. The sensor is selected to detect a predetermined level of moisture and to provide an indication when such predetermined level has been detected. In an example, once such predetermined level of moisture has been detected, an output signal is provided. If desired, the device can comprises a sensor that is additionally selected to detect an elevated temperature condition.

The output signal can be used to alert the user and/or alter the operation of the device. The user alert can be visual and/or audible, and the altered operation of the device can include altering one or more function of the device, shutting the device off, and/or shutting off one or more of the moisture-sensitive components in the housing. The output signal can also be directed to a component that is remote from the device, e.g., to a remote device via wireless signal transfer. Configured in this manner, such device constructions operate to alert a user of a high-moisture condition, which can serve to reduce or eliminate the extent of any moisture-related damage to the device to thereby preserve device service life.

BRIEF DESCRIPTION OF THE DRAWINGS

These and other features and advantages of electrical device constructions and methods for making the same as disclosed herein will be appreciated as the same becomes better understood by reference to the following detailed description when considered in connection with the accompanying drawings.

DETAILED DESCRIPTION

Electrical devices or apparatus configured to provide a self-protecting capacity through the use of a sensor disposed therein, and methods used in conjunction with such devices, are disclosed herein. Such electrical devices are configured to include a moisture or humidity sensor disposed therein, e.g., within a housing of the device, which housing includes one or more electrical and/or mechanical components or elements that are disposed therein. Wherein one or more of such electrical and/or mechanical components can have a performance feature that is sensitive to moisture. As used herein, the term "moisture" is understood to include moisture in the form of liquid such as water, as well as when present in gas or air as humidity.

Figure 1:
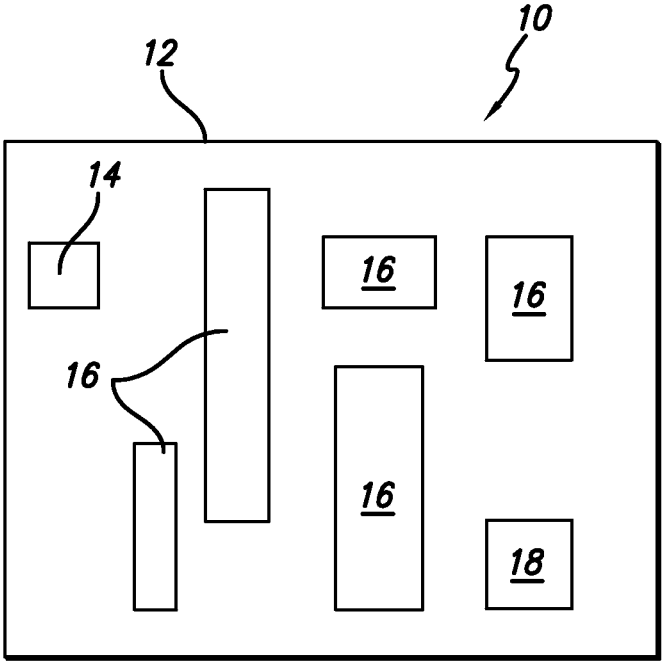
FIG. 1 is a perspective view of an example electrical device as disclosed herein.

FIG. 1 illustrates an example electrical device or apparatus 10 comprising a housing 12 and a moisture detector or sensor 14 disposed within the housing 12. The housing also comprises one or more electrical and/or mechanical components 16 disposed therein. The one or more electrical and/or mechanical components can have a performance feature that is sensitive to the presence of moisture. The housing 12 may or may not include a power source disposed therein, e.g., the power source may be provided in the form of a battery that is disposed within the housing or that is located remotely from the housing and electrically connected thereto by an appropriate electrical conductor such as a wire, cable, or the like. In the example illustrated, the housing includes a battery 18 disposed therein.

The moisture detector or sensor 14 can be positioned in various different locations within the electrical device housing 12. The particular placement position can relate to the location of the electrical and/or mechanical components or other moisture-sensitive components within the housing, and/or to any leak paths known or suspected to exist in the housing, e.g., near openings in the housing provided for an electrical lead passage, user operated buttons, or the like. Additionally, the packaging of the electrical and/or mechanical components can dictate the placement position of the moisture sensor within the housing. In an example, the moisture sensor is positioned adjacent a known or suspected leak path in the electrical device housing so that it can provide an early detection of moisture entering into the housing.

In a preferred example, the moisture sensor is positioned adjacent such known or suspected housing leak path, and is interposed between such known or suspected moisture leak path and the electrical and/or mechanical components to again provide an early indication of moisture entry into the device before such moisture makes contact with the components, i.e., the moisture sensor is preferably positioned upstream from the components relative to the path of any moisture flow into the device housing.

Moisture sensors that can be used in conjunction with electrical devices as disclosed herein are ones that are configured to detect a predetermined level of moisture. The sensor can be configured to provide a signal upon detecting moisture and the electrical device can be configured so alert the user of the electrical device to the detected presence of moisture, and/or to cause one or more of the electrical components in the electrical device to be shut off to protect the same from damage that may result from continued use of the device in such detected high-moisture environment.

Figure 2:
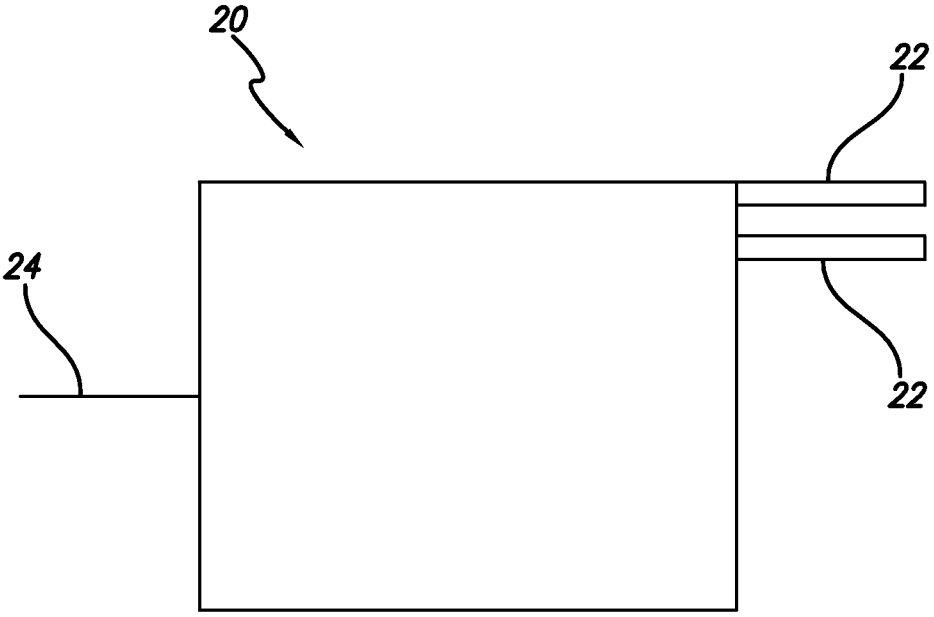
FIG. 2 is a perspective view of a moisture detector or sensor used with electrical devices as disclosed herein.

FIG. 2 illustrates an example moisture sensor 20 comprising a pair of electrical conductors 22 that are spaced apart a determined distance and that operate on the principle of measuring the electrical conductivity between two conductors, wherein the conductivity between the conductors is zero when exposed in an air environment and increases when exposed to moisture. The sensitivity of the sensor 20 in detecting the change of conductivity due to the presence of moisture can and will vary depending on the particular electrical device end-use application. Additionally, while such moisture sensor has been described and illustrated for purposes of reference and example, it is to be understood that moisture sensors other than that specifically disclosed and illustrated in FIG. 1, which may operate using principals other than conductivity, can be used in conjunction with electrical devices as disclosed herein without departing from the scope of this disclosure.

The sensor 20 can include one or more electrical connections 24 or leads running to and/or from the electrical device for desired operation of the electrical device in a particular end-use application. In an example, the moisture sensor 20 comprises a signal lead running from it for the purpose of communicating a moisture detection signal to a further device or component of the electrical device for purposes of identifying the detected presence of moisture, wherein the electrical device is then configured to signal an alarm, and/or suspend or otherwise alter operation of one or more electrical and/or mechanical components disposed therein to preserve the functionality of the electrical and/or mechanical components and thus the electrical device.

If desired, the moisture sensor can be configured to provide an indication of not only detected moisture or humidity, but additionally temperature. An example of such moisture sensor useful in this regard includes those available from Sensirion AG of Switzerland under its line of digital humidity and temperature sensors. Such humidity sensors are configured to operate on the capacitive measurement principle, wherein the sensor element is built out of a capacitor. The dielectric is a polymer which absorbs or releases water proportional to the relative environmental humidity, and thus changes the capacitance of the capacitor. This change in capacitance can be measured by an electronic circuit, which allows the relative air humidity to be determined.

Electrical devices as disclosed herein, comprising the use of a moisture sensor, include all types of electrical devices comprising electrical and/or mechanical components disposed therein, and that can be held or worn by a user and as a result may be subjected to a high-moisture environment. Example electrical devices include and are not limited to battery-powered audio, video, audio/video devices, and wireless or "hands-free" microphones and receivers such as Bluetooth connected devices that are worn on a person's head. Also included are all other types of electrical devices that may be worn by a person on their head, such as hearing prosthesis, and the external components of hearing prosthesis which include an implanted component.

Figure 3:
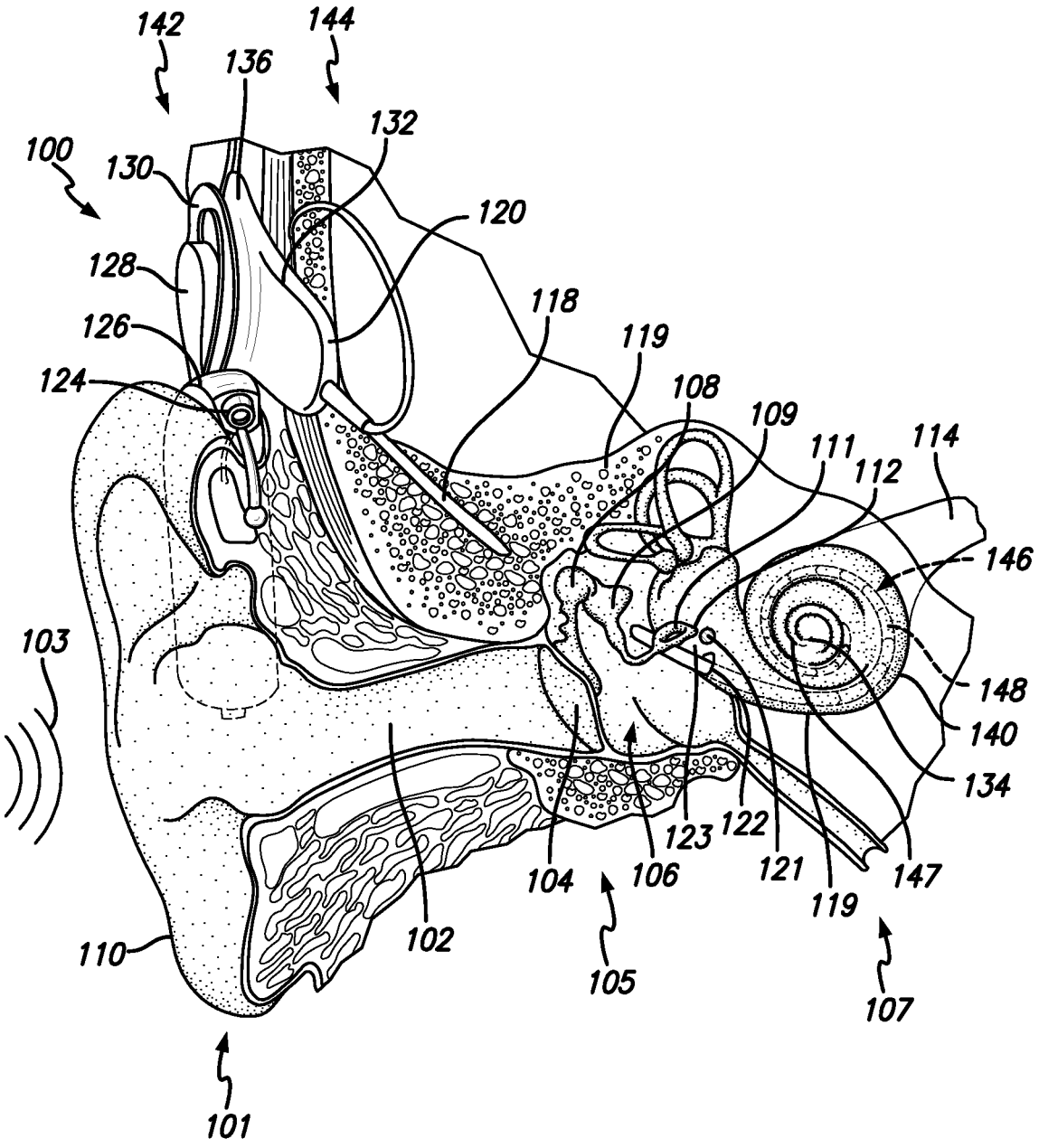
FIG. 3 is a perspective view of an example hearing prosthesis comprising an external electrical component.

FIG. 3 illustrates the different components of an example hearing prosthesis; namely, a cochlear implant system 100 that includes both internal and external components. In an example the internal component 144 typically has an internal receiver/transceiver unit 132, a stimulator unit 120, and an elongate stimulating assembly 118. The internal receiver/transceiver unit 132 permits the cochlear implant system 100 to receive and/or transmit signals to an external component 126 that is worn behind a recipient's ear. The internal receiver/transceiver unit 132 includes an internal coil 136, and preferably, a magnet (not shown) fixed relative to the internal coil 136. The internal receiver unit 132 and stimulator unit 120 are hermetically sealed within a biocompatible housing, sometimes collectively referred to as a stimulator/receiver unit. The magnets facilitate the operational alignment of the external and internal coils, enabling internal coil 136 to receive power and stimulation data from an external coil 130 that is worn on an outside portion of a recipient's head, and that is also an external component.

The elongate stimulating assembly 118 has a proximal end connected to stimulator unit 120, and a distal end implanted in cochlea 140. Stimulating assembly 118 extends from stimulator unit 120 to the cochlea 140 through mastoid bone 119. In certain examples, the external coil 130 transmits electrical signals (e.g., power and stimulation data) to the internal coil 136 via a radio frequency (RF) link. The internal coil 136 is typically a wire antenna coil comprised of multiple turns of electrically insulated single-strand or multi-strand platinum or gold wire. The electrical insulation of the internal coil 136 is provided by a flexible silicone molding (not shown). In use, implantable receiver unit 132 may be positioned in a recess of the temporal bone adjacent auricle 110 of the recipient. Various types of energy transfer, such as infrared (IR), electromagnetic, capacitive and inductive transfer, may be used to transfer the power and/or data from the external component or device 126 to the cochlear implant.

Figure 4:
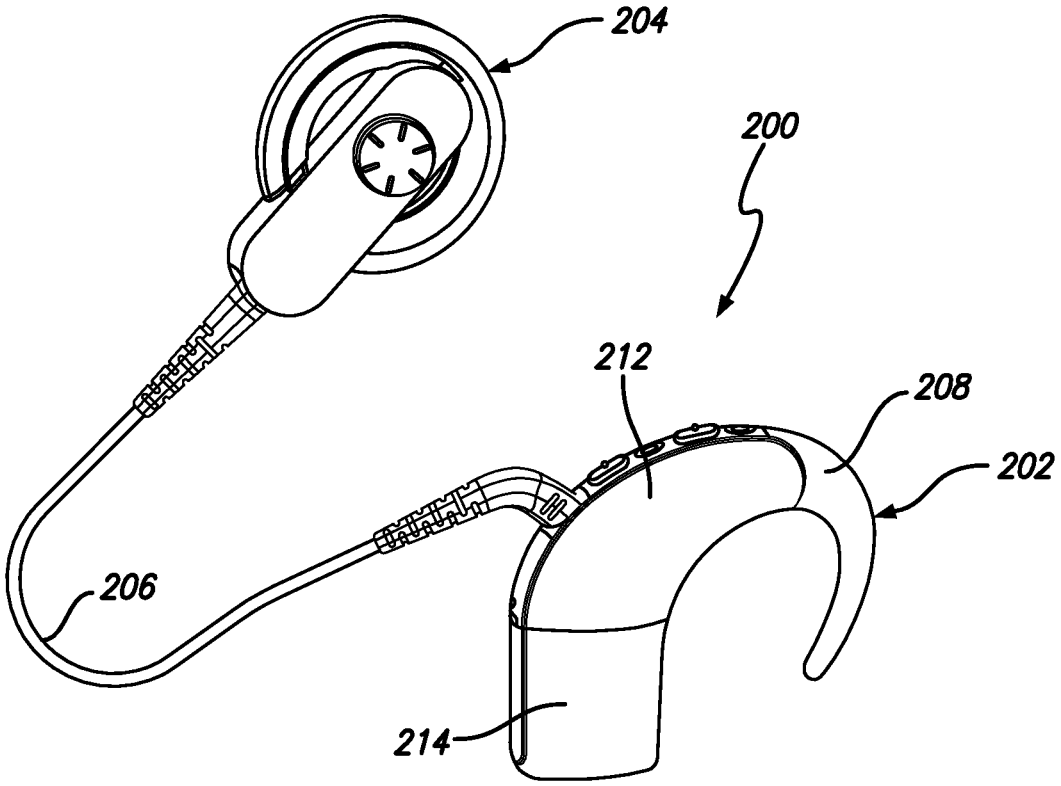
FIG. 4 is a perspective view of external electrical components from the hearing prosthesis of FIG. 3.
Figure 5:
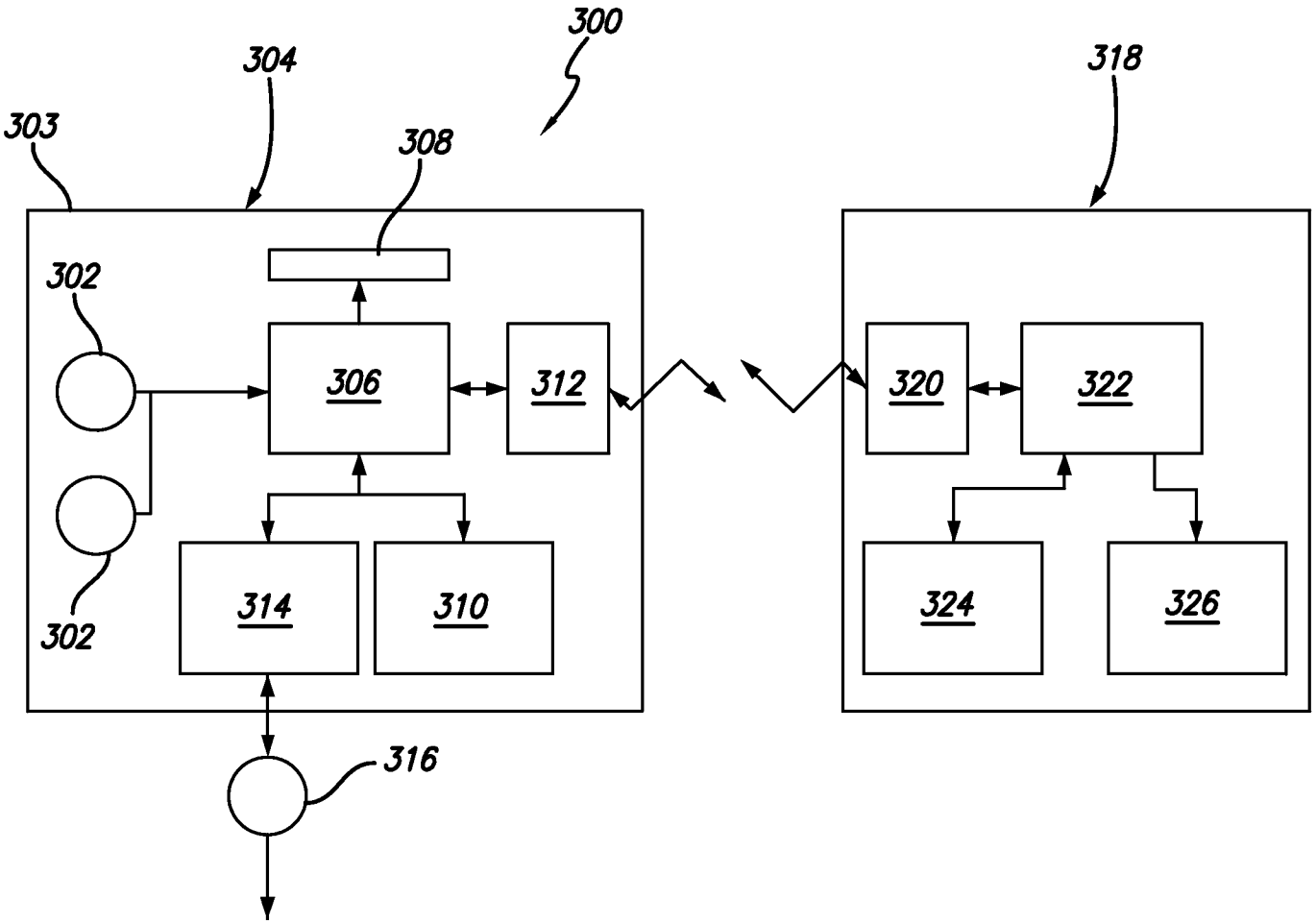
FIG. 5 is a schematic block view of an example electrical device comprising a moisture detector or sensor disposed within an external component of a hearing prosthesis.

FIG. 4 illustrates external components 200 of the example hearing prosthesis disclosed above and illustrated in FIG. 5, which includes a sound processing unit 202 and an external coil or transmitter 204 that are connected to one another by an external cable 206. The sound processing unit 202 is configured comprising an ear hook 208 to secure the unit behind a recipient's outer ear. The unit 202 includes a microphone (not shown) and includes a processor 212 that filters and manipulates the electrical impulses received from the microphone and transmits processed electrical sound signals along the external cable 206 to the transmitter 204. The processor 212, microphone, and transmitter 204 are powered by a battery 214.

FIG. 5 illustrates an example electrical device 300 wherein the moisture sensor 302 is positioned inside a housing 303 of an external hearing prosthesis component 304, e.g., a behind-the-ear device, for detecting moisture leakage into the housing. In such example, the moisture sensor is one configured to fit within the housing, and one preferably constructed to consume little operating power from the component 304. Signals from the moisture sensor 302 are connected to a micro controller (uC) 306 configured to control the external component 304. The uC 306 may include software configured to provide a variety of different outputs/actions based on the signal provided when the moisture sensor indicates the presence of excessive moisture.

The external component 304 can include the following other components connected to the uC 306, which other components can include one or more of a visual indication means 308 (such as one or more light-emitting diodes that can be viewed from outside of the component 304), a non-volatile memory 310 (such as a Flash memory or the like), a wireless communication means 312 (such as an ISM band wireless radio, where ISM stands for industrial, scientific and medical), and a digital signal processing pool 314, which can be connected by radio frequency link 316 to a recipient.

Additionally, such external component 304 can be configured for communicating with a remote control 318, e.g., through the use of the wireless communication means 312. In an example, such remote control 318 includes a wireless communication means 320 configured to communicate with the wireless communication means 312 in the external component 304. The remote control 318 can also include a uC 322 connected with the wireless communication means 320. In such example, the uC 322 is connected with a non-volatile memory 324 (such as a Flash memory or the like), and a user interface 326 which may be provided in the form of an visual display, e.g., an LCD display, and/or which may comprise a variety of different audio and/or visual indication devices.

Electrical devices as disclosed herein, comprising the moisture sensor as used in conjunction with a hearing prosthesis, may be configured to provide one or more different types of outputs in response to the detection of excessive moisture. Such outputs can include and not be limited to altering the function and/or shutting down one or more of the electrical components of the hearing prosthesis, providing a visual and/or audio alarm or indication to the user or recipient, recording or logging the event into a memory device, and any combination thereof. Additionally, upon an initial detection of excessive moisture, the construction can be configured to recheck the moisture presence once or serially at random or predetermined intervals.

Figure 6:
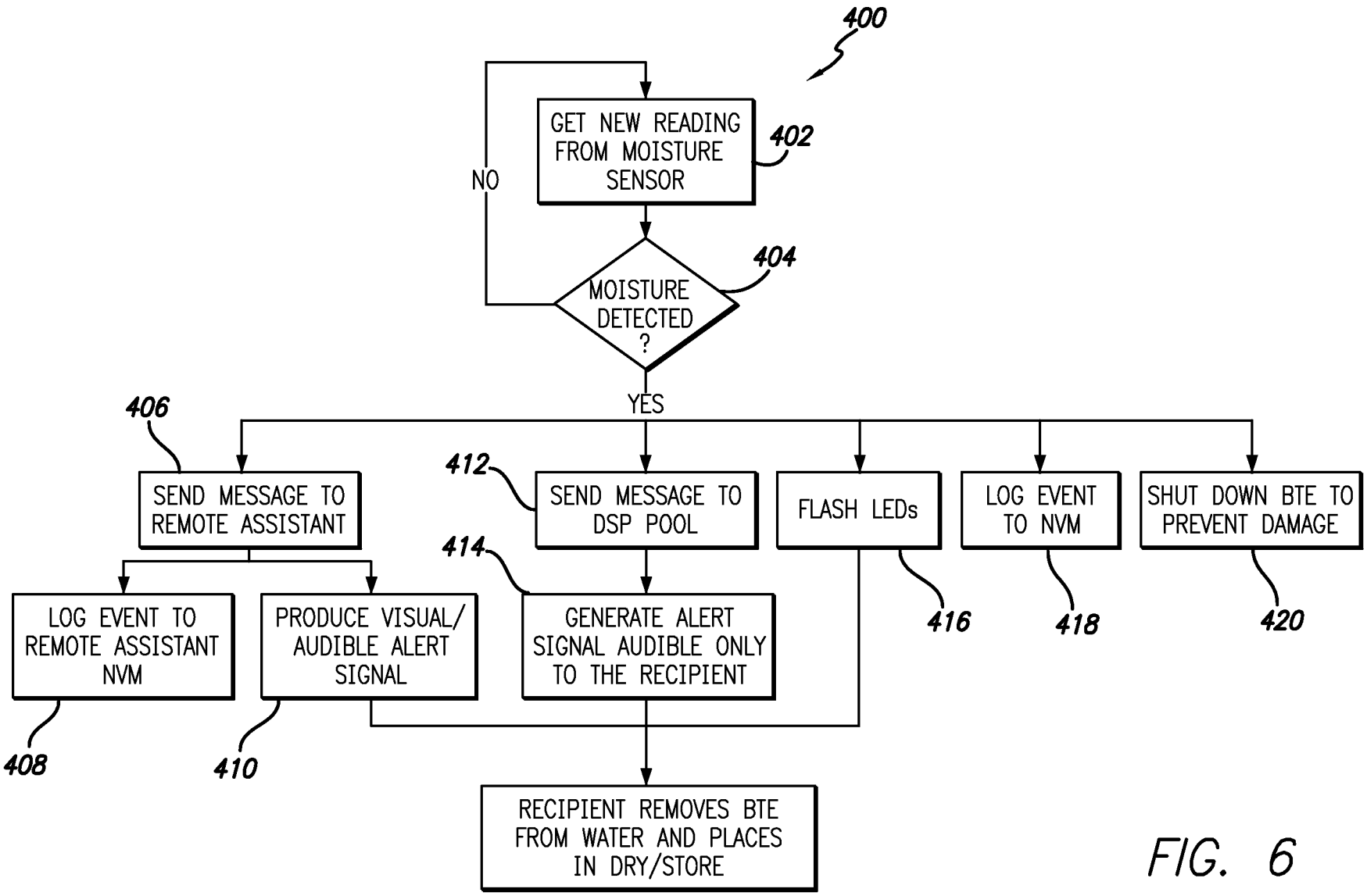
FIG. 6 is flow diagram illustrating example actions or steps that can be implemented in association with the detection of moisture by the electrical device of FIG. 5.

FIG. 6 is a flow diagram 400 for an example electrical device illustrating the different steps or actions that can be taken for a device comprising a moisture sensor as used with a hearing prosthesis upon the detection of excessive moisture. Initially, a reading from the moisture sensor is taken 402 and it is determined whether excessive moisture is detected 404. If it is not, readings from the moisture sensor can be retaken at random or regular intervals. If excessive moisture is detected, then the construction can be configured to provide one or any combination of outputs. Examples of such outputs include sending a message or communication to a remote control or remote assistant 406, which message can be logged or stored into the memory of the remote control or remote assistant 408, and/or which message can produce a visual and/or audible alert signal 410 to the user or recipient.

Another example output can be to send a message to the digital processing pool 412 of the external component, which can operate to generate an alert signal audible to the user or recipient 414. Other example outputs include providing a visual alarm indication 416, e.g., in the form of flashing light emitting diodes on the external component, and/or logging the event to the non-volatile memory 418 in the external component, and/or shutting down the external component to prevent further damage 420. As noted above, the construction can be configured to produce an output for activating any one or any combination of the above-identified outcomes. In an example, providing such output (indicative of the detection of excessive moisture) enables the user or recipient to remove the external component from such high-moisture environment and place it in a dry environment 422 to avoid unwanted damage.

The outputs described above and illustrated in FIG. 6 are those of a particular example. It is, therefore, understood that electrical devices as disclosed herein may be configured to provide outputs other than those described above and any such other outputs used for the purpose of warning the user or recipient of the excessive moisture condition, and/or recording the event, and/or preserving the external component from damage are within the scope of the construction as disclosed herein.

While example electrical devices comprising the use of moisture sensors used in conjunction with a specific type of hearing prosthesis (e.g., a cochlear implant) has been disclosed and illustrated, it is to be understood that electrical devices as disclosed herein can be used with other types of hearing prosthesis comprising one or more external components. Non-limiting examples of such other types of hearing prosthesis include coil-sound hearing prosthesis, button-processor hearing prosthesis, bone-conduction hearing prosthesis, and all such other types of hearing prosthesis comprise one or more external component that includes electrical components or other moisture-sensitive components or elements, and that are worn on the head of a user or recipient.

Certain example electrical devices comprising moisture sensors and methods for using the same have been disclosed. While such electrical devices and methods have been described with respect to a limited number of examples, the specific features of one example electrical device should not necessarily be attributed to other examples of electrical devices. No single example is representative of all aspects of electrical devices and methods of using the same as disclosed herein. In some examples, the electrical device or method of using the same may comprise features or steps not mentioned herein. Variations and modifications from the described examples exist. The different outputs or steps of operating an electrical device as disclosed herein comprise one or more acts or steps. These steps or acts may be practiced in any sequence or order unless otherwise indicated. Finally, any number disclosed herein should be construed to mean approximate, regardless of whether the word "about" or "approximately" is used in describing the number. The appended claims intend to cover all those modifications and variations as falling within the scope of the constructions and methods for making the same as disclosed herein.

In an exemplary embodiment, there is a device as described herein wherein the device comprises a receiver component that receives a signal from an electrical device. In an exemplary embodiment, there is a device as described herein, wherein the electrical device is a cellular phone, and the receiver component comprises a remote receiver.

What is claimed is:

1. An apparatus comprising:

a component of a hearing prosthesis, the component having a housing that includes an electrical component disposed therein; and a sensor disposed within the housing for detecting moisture;

wherein the apparatus is configured to provide an output when moisture is detected by the sensor, wherein the output is used to place the hearing prosthesis in an alternate state of operation that is other than a normal state of operation, and wherein:

the housing is worn on a user's head.

2. The apparatus as recited in claim 1 wherein the component includes one or both of a visual indicator or a speaker, and wherein the output is used to produce one or both of a visual indication and an audible indication respectively using the visual indicator or the speaker that is part of the component.

3. The apparatus as recited in claim 1 wherein the output is wiredley provided to a device that is remote from the component.

4. The apparatus as recited in claim 1, wherein the apparatus is a battery-powered electrical prosthesis.

5. The apparatus as recited in claim 1 wherein the apparatus is configured to perform one or more functions selected from the group consisting of providing a visual alarm, providing an audible alarm, providing data information, change the state of operation of one or more of the components disposed within the housing from a normal state to an alternative state, and combinations thereof.

6. The apparatus as recited in claim 1 wherein the apparatus comprises a receiver component that receives a signal from an electrical device.

7. The apparatus as recited in claim 6 wherein the electrical device is a cellular phone, and the receiver component comprises a remote receiver.

8. The apparatus as recited in claim 1 wherein the housing is a housing of a Behind-The-Ear device that includes an ear hook configured to extend over a pinna of a recipient.

9. An apparatus comprising:

a component of a hearing prosthesis, the component having a housing that includes an electrical component disposed therein; and a sensor disposed within the housing for detecting moisture;

wherein the apparatus is configured to provide an output when moisture is detected by the sensor, wherein the output is used to place the hearing prosthesis in an alternate state of operation that is other than a normal state of operation, wherein the sensor is shielded from an ambient environment by the housing, and wherein at least one of:

(i) the output is used to provide information data and the information data is stored;

(ii) the housing is worn on a user's head; or (iii) the moisture sensor is positioned within the housing adjacent an opening through the housing.

10. The apparatus as recited in claim 9 wherein the output is used to provide the information data.

11. The apparatus as recited in claim 10 wherein the information data is stored.

12. The apparatus as recited in claim 9 wherein the housing is worn on the user's head.

13. The apparatus as recited in claim 12 wherein the housing is worn adjacent a user's ear.

14. The apparatus as recited in claim 9 wherein the moisture sensor is positioned within the housing adjacent the opening through the housing.

15. The apparatus as recited in claim 9 wherein the housing comprises a moisture-sensitive component disposed therein.

16. The apparatus as recited in claim 15 wherein the moisture-sensitive component is the electrical component.

17. A method for detecting the presence of moisture within a device worn on a user's head, the method comprising the steps of:

operating a sensor within a housing of the device, wherein the housing comprises a moisture-sensitive component disposed therein, and wherein the sensor is configured to detect the presence of moisture; and providing an indication when the sensor detects moisture, wherein the indication is used to alert the user and/or alter the operation of the device, wherein during the step of providing, the indication is used to shut the device off, and the method further includes transmitting a signal from the device transcutaneously into the head of the recipient utilizing a coil of the device, wherein the signal is a radio frequency signal.

18. The method as recited in claim 17 wherein the indication to alert the user is in the form of a visual alert and/or an audible alert.

19. The method as recited in claim 17 wherein the during the step of providing, data information is provided.

20. The method as recited in claim 17 wherein the device is an external component of a hearing prosthesis.

21. The method as recited in claim 17 wherein at least one of:

the sensor is positioned adjacent an opening through the housing; or the sensor is one that also detects temperature.

22. The method as recited in claim 17 wherein at least one of:

the sensor is positioned adjacent an opening through the housing;

the sensor is one that also detects temperature; or the device is an external component of a hearing prosthesis.

23. The method of claim 17, wherein:

the device is a Behind-The-Ear device that includes an ear hook configured to extend over a pinna of a recipient.

24. The method as recited in claim 17 wherein the signal contains sound data based on sound captured by the device, the method further comprises evoking a hearing percept based on the transcutaneously transmitted signal.

25. The method of claim 17, wherein the device includes an external transmitter coil corresponding to the coil of the device connected to the housing, wherein the external transmitter coil is located completely outside the housing and the sensor is entirely located within the housing.

26. A method for detecting the presence of moisture within a device worn on a user's head, the method comprising the steps of:

operating a sensor within a housing of the device, wherein the housing comprises a moisture-sensitive component disposed therein, and wherein the sensor is configured to detect the presence of moisture; and providing an indication when the sensor detects moisture, wherein the indication is used to alert the user and/or alter the operation of the device, wherein during the step of providing, the indication is used to shut the device off, and the device is part of a cochlear implant.

27. The method as recited in claim 26 wherein the sensor is positioned adjacent an opening through the housing.

28. The method as recited in claim 27 wherein the sensor is positioned within the housing at a location interposed between the opening and the moisture-sensitive component.

29. The method as recited in claim 26 where the sensor is one that also detects temperature.

30. The method as recited in claim 26 wherein an output is provided to an electrical component disposed within the housing.

31. The method as recited in claim 26 wherein an output is provided to a component remote from the device.

32. The method as recited in claim 26, further including transmitting a signal from the device utilizing a coil of the device, wherein the signal is a radio frequency signal, and wherein the coil is held against the head using a magnet.

33. The method of claim 26, wherein the device includes a battery located outside the housing, wherein no battery is located within the housing.

34. The method as recited in claim 26 further including: transmitting a signal from the device transcutaneously into the head of the recipient utilizing a coil of the device, wherein the signal is a radio frequency signal, and wherein the coil is held against the head via a transcutaneous magnetic field.

* * * * *